US006974044B1

(12) United States Patent
Munnekehoff

(10) Patent No.: US 6,974,044 B1
(45) Date of Patent: Dec. 13, 2005

(54) SYSTEM AND DEVICE FOR CONTROLLING A LOAD LIFTING DEVICE

(76) Inventor: Gerd Munnekehoff, Langestr. 80, 42857 Remscheid (DE)

( * ) Notice: Subject to any disclaimer, the term of this patent is extended or adjusted under 35 U.S.C. 154(b) by 0 days.

(21) Appl. No.: 09/913,369

(22) PCT Filed: Oct. 2, 2000

(86) PCT No.: PCT/EP00/01067

§ 371 (c)(1),
(2), (4) Date: Nov. 23, 2001

(87) PCT Pub. No.: WO00/47512

PCT Pub. Date: Aug. 17, 2000

(30) Foreign Application Priority Data

Feb. 11, 1999 (DE) ..... 299 02 364 U

(51) Int. Cl.[7] ..... B66D 1/00
(52) U.S. Cl. ..... 212/331; 212/284; 254/270; 701/264
(58) Field of Search ..... 700/260, 261, 700/264; 212/284, 331; 257/270

(56) References Cited

U.S. PATENT DOCUMENTS 3,841,605 A * 10/1974 Joraku et al. ..... 254/127
3,887,855 A * 6/1975 Klimo ..... 318/257
3,945,612 A * 3/1976 Motoda ..... 254/173 R
4,087,078 A * 5/1978 Joraku et al. ..... 254/362
4,807,767 A * 2/1989 Kornely ..... 212/159
5,522,581 A * 6/1996 Kulhavy ..... 254/267
5,850,928 A * 12/1998 Kahlmann et al. ..... 212/285
5,865,426 A * 2/1999 Kazerooni ..... 254/270
5,960,969 A * 10/1999 Habisohn ..... 212/275
6,394,731 B1 * 5/2002 Konosu et al. ..... 414/5

FOREIGN PATENT DOCUMENTS

| | | |
|---|---|---|
| DE | 4415518 | 11/1995 |
| DE | 29719865 | 3/1998 |
| EP | 0733579 | 9/1996 |

* cited by examiner

*Primary Examiner*—Thomas J. Brahan
(74) *Attorney, Agent, or Firm*—Merchant & Gould

(57) ABSTRACT

The invention relates to a system for controlling a load lifting device (1) with a controllable drive (2) and a lifting element (5) which is linked with the drive (2) and which is—at least in a non-operational position due to the gravitational force—vertically (Z—Z) aligned. A load receiving element (7) is linked with the lifting element (5). The system further comprises a control circuit for balancing the loads. Said control circuit encompasses a device for producing a path-dependent signal which corresponds to a substantially vertical (Z—Z) movement of the lifting element (5) and which represents the input signal for the control of the drive (2).

3 Claims, 6 Drawing Sheets

SYSTEM AND DEVICE FOR CONTROLLING A LOAD LIFTING DEVICE

FIELD OF THE INVENTION

The present relates to a system for controlling a load-lifting apparatus, having a controllable drive, having a load-bearing element which is connected to the drive and is aligned vertically—as a result of gravitational force at least in a rest position—having a load-receiving device which is connected to the load-bearing element, and having a regulating circuit for load-balancing purposes. The invention also relates to a control method which can be implemented, in particular, by means of such a system.

BACKGROUND OF THE INVENTION

Systems of the above-mentioned type are known with load-lifting apparatuses which are driven by electric motors and fluidic means. They serve for avoiding too much physical exertion in the case of manually guided movements of all types of loads retained on the load-receiving device. As a result of the load-balancing, the load hangs at a selected height here and can be guided into its intended position with a minimal amount of force being applied. Such a system, which comprises a crane trolley guided on a running-rail structure in at least one horizontal direction, is known, for example, from German Utility Model DE 297 19 865 U1. It may be possible for the load-bearing element of the known load-lifting apparatuses to be flexible and to be wound up on a drum (for example, cable, or chain), or it may also be flexurally rigid.

A load-lifting apparatus with a flexurally rigid load-bearing element is known, for example, from DE 4342715 A1. This laid-open application describes a manually guided manipulator which has a vertical bearing journal about which a horizontally projecting load-bearing arm can be pivoted.

At its end which is directed away from the bearing journal, the load-bearing arm bears a lifting apparatus which has a load-receiving means at its bottom end. The load-bearing arm comprises two sub-arms which are arranged one behind the other and are connected to one another by a joint with a vertical pivot axis and thus form an angled arm. The load-bearing arm has a further angled arm which is formed from two sub-arms and supplements the first to form a changeable parallelogram located in a horizontal plane.

In the case of some known control systems for load-lifting apparatuses, the magnitude of the empty weight and of the load which is to be received has to be preset on a regulator. In order to avoid this disadvantage, it is also possible, as is known from EP 0 733 579 A1, to provide weight-determining means on the load-lifting apparatus.

SUMMARY OF THE PRESENT INVENTION

The object of the present invention is to provide a control system of the above-mentioned type and a corresponding method which can be used, without the weight being preset, to realize load-balancing in a straightforward manner in control terms, the intention also being to ensure convenient operation with a simultaneously high level of safety.

This is achieved according to the invention in that the regulating circuit for load-balancing purposes comprises a device for generating a path-dependent signal, which corresponds to an essentially vertical movement of the load-bearing element and serves as an input signal for controlling the drive.

Once the load has been received in the load-receiving device, it is thus advantageously possible for a force applied by the drive or a corresponding torque to be rapidly increased automatically until it corresponds to the weight of the load. The increase in the drive power can take place, in the case of a drive driven by an electric motor, by motor-current control or, in the case of a fluidic drive, by controlling the fluid pressure, for example with the aid of a servovalve. The point in time at which the weight compensation has been achieved may be determined here with the aid of the device for generating the path-dependent signal. The balanced state has been set when, under the action of the drive, the essentially vertical movement of the load-bearing element commences. The magnitude of the path-dependent signal here may advantageously be compared with a desired value and, when the latter has been reached, the force applied by the drive or the torque can be kept constant at the value reached. The weight is thus balanced fully automatically. The detection of the desired value takes place in the millisecond range and is thus so quick that the vertical movement of the load-bearing element is not perceived by the operator and thus, in addition, cannot have a disruptive effect on the operation.

The drive may be, in particular, an electric motor which has the device for generating the path-dependent signal, as is the case, in particular, with an electric servomotor, wherein the path-dependent signal corresponds to an angle of rotation and can be picked up directly from the motor. In the case of other types of electric motors, it is advantageously possible to provide, for example, that the device for generating the path-dependent signal is an incremental encoder arranged coaxially with the drive shaft of the motor.

The invention may also advantageously be used for load-lifting apparatuses in which the drive is a fluidically acting drive device, such as a pneumatic piston/cylinder arrangement or a pneumatically activated recirculating ball screw.

For a further easy-to-operate configuration of the system, it is possible to provide a controller for the vertical movement of the load-bearing element, in which case the controller comprises a control member, a handling device for the load-receiving device and a device for generating a force-dependent signal, the force-dependent signal corresponding to a manipulation force acting vertically on the handling device, and the control member being designed such that, in dependence on the deviation of the force-dependent signal from a desired value, it emits a control signal for the drive for the purpose of initiating a movement of the load-bearing element, said movement corresponding to the direction and preferably also to the magnitude of the manipulation force.

In a further configuration of the invention, it is also possible to change both the predetermined desired value and the transmission behavior of the control member by a setting member in dependence on a signal corresponding to the load. Such guidance regulation advantageously allow compensation of load-induced frictional forces occurring in the system according to the invention.

A further advantage of the invention is that all the members of the system according to the invention which have a control or regulating function, such as the control member of the controller for the vertical movement of the load-bearing element, the setting member for the desired value of said controller, etc., may be constituent parts of a single programmable controller.

Further advantageous features of the invention are contained in the following description.

BRIEF DESCRIPTION OF DRAWING

The invention will now be explained more precisely with reference to preferred exemplary embodiments illustrated in the drawing, in which.

The same parts are always provided with the same designations in the various figures of the drawing, so that it is also the case that they are usually described only once each.

Figure 1:
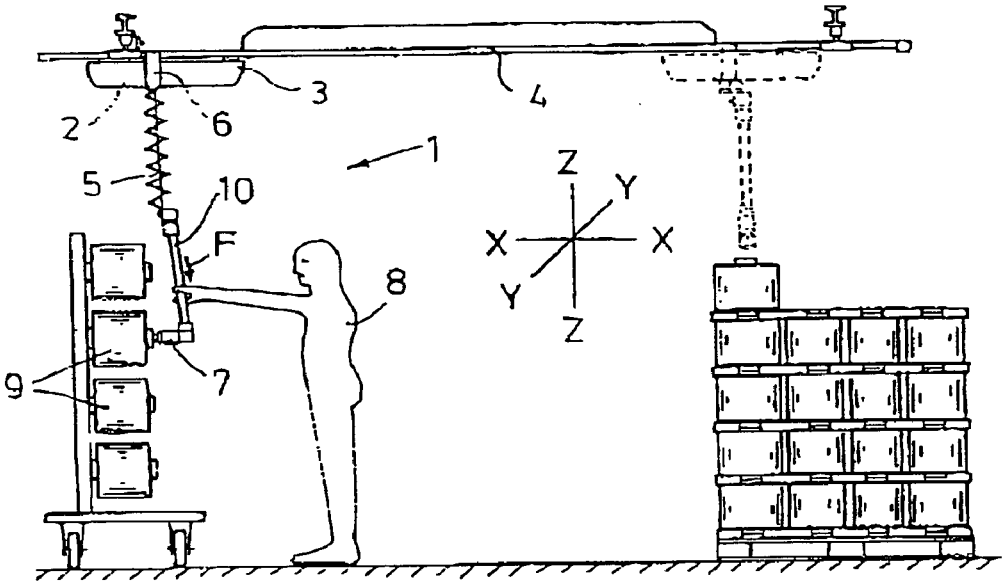
FIG. 1 shows a basic illustration of the use of a system for controlling a load-lifting apparatus.

As FIG. 1 shows, a system for controlling a load-lifting apparatus 1 has a controllable drive 2, which is arranged in a lifting subassembly 3. The lifting subassembly 3 is designed as a crane trolley which is guided on a running-rail structure 4 in at least one horizontal direction X—X. Connected to the drive 2 is a load-bearing element 5 which is aligned in the vertical (Z—Z) direction—as a result of gravitational force at least in a rest position. The load-bearing element 5 is a cable which can be wound up flexibly and onto a drum 6 located in the interior of the lifting subassembly 3.

Figure 2:
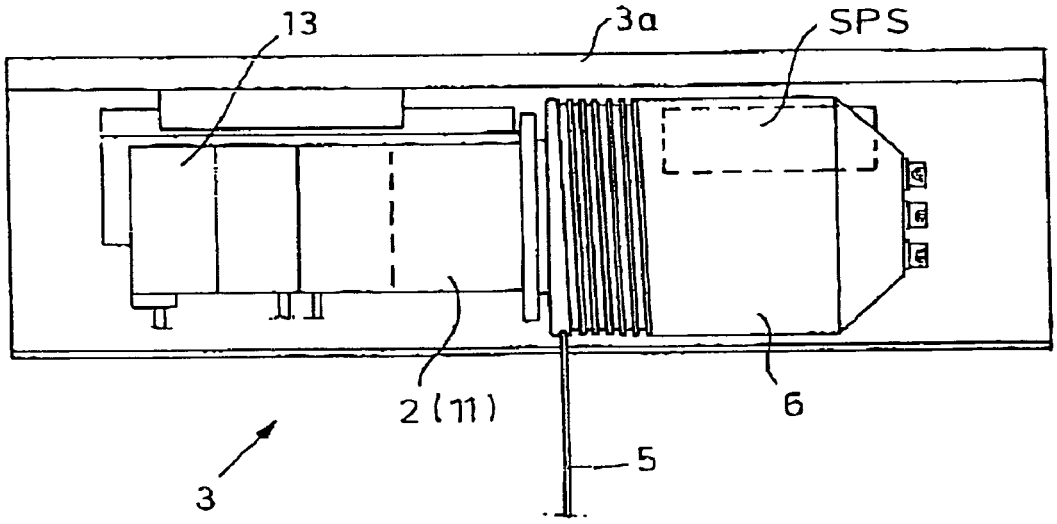
FIG. 2 shows a section through a lifting subassembly of a system according to the invention with an electromotive drive.

The sectional illustration in FIG. 2 shows, in a first variant, how the lifting subassembly 3 may be designed specifically. The lifting subassembly 3 has a housing 3*a* in which there are located, as electromotive drive 2, a servomotor and the drum 6 for winding up the cable.

A load-receiving device 7 is connected to the load-bearing element 5. Said load-receiving device, in the case illustrated, is a device with a load-receiving mechanism which can be operated manually by an operator 8, in particular with clamping grippers for receiving a load 9 with a cylindrical receiving opening, e.g. a reel.

Fastened at the free end of the load-bearing element 5 is a handling device 10 for the load-receiving device 7, which also serves for movement guidance.

Figure 3:
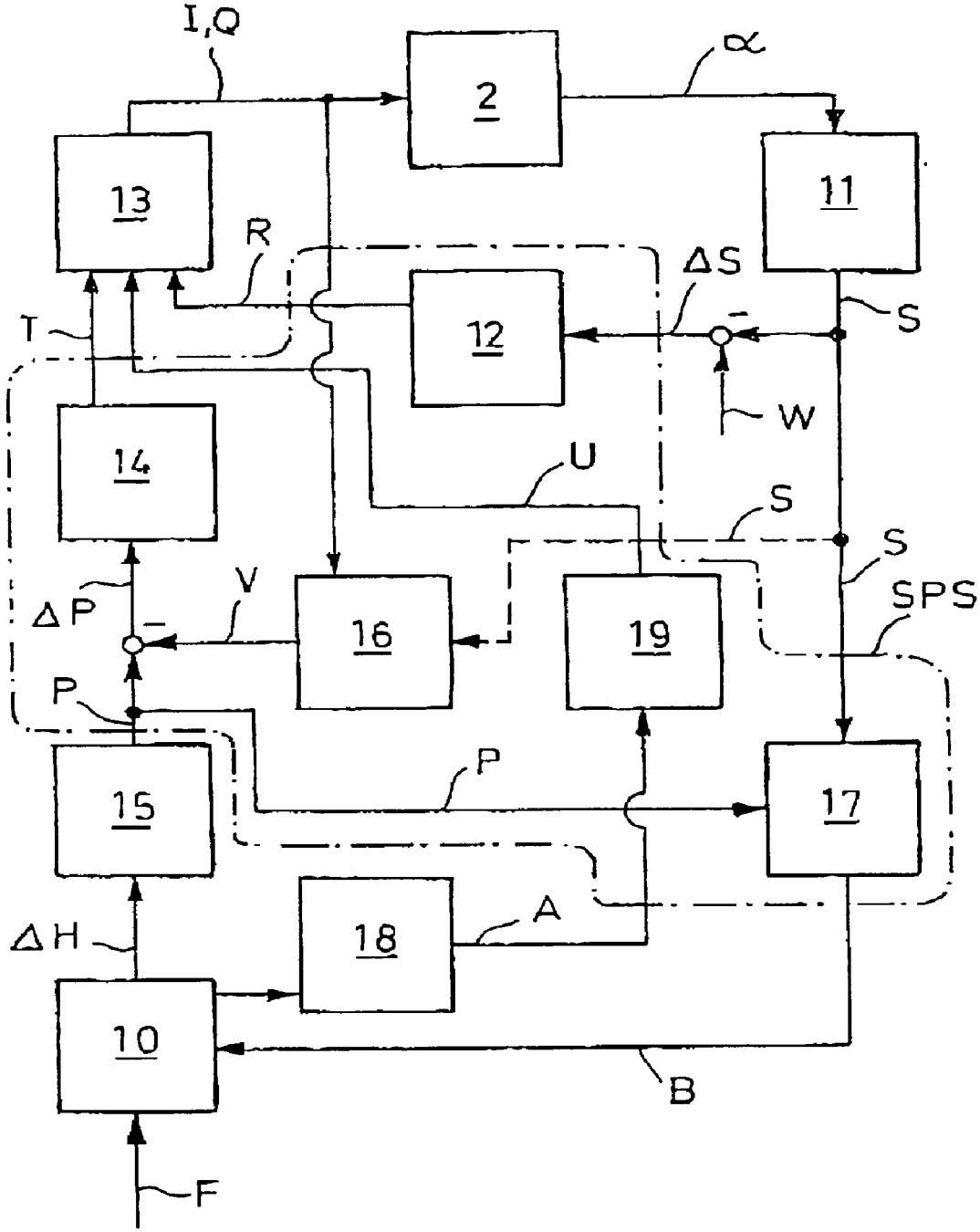
FIG. 3 shows a schematic illustration of the controller of a system according to the invention.

As the schematic illustration of the controller of a system according to the invention in FIG. 3 shows, said system comprises a regulating circuit for load-balancing purposes. Provided in said regulating circuit is a device 11 for producing a path-dependent signal S, which corresponds to an essentially vertical movement of the load-bearing element 5 and serves as an input signal for controlling the drive 2. The regulating circuit also contains a regulating member 12 which is designed such that, in dependence on a deviation AS of the path-dependent signal S from a desired value W, it can emit, to an actuating member 13 for the drive 2, a regulating signal R for the movement of the load-bearing element 5. The actuating member 13 may be, for example, a device for changing the motor torque (manipulated variable 1) of an electric motor, such as the servocontroller illustrated in FIG. 2, or the pressure Q in a fluidic device, such as the servovalve illustrated in FIG. 6.

Once a load 9 has been received by means of the load-receiving device 7, a torque applied by the drive 2 is rapidly increased automatically until it corresponds to the weight of the load 9 received. In this case, in order to determine that a balanced state for the load 9, once reached, has been set, the path-dependent signal S is determined. This signal S contains information relating to the beginning and/or the initial course of a load movement which commences following weight compensation. The path-dependent signal S is compared with the desired value W (formation of the deviation AS). When the signal S and desired value W correspond (AS—0), the torque applied by the drive 2 is kept constant at the value reached. The regulating signal R here serves for constant-switching purposes. The movement of the load-bearing element 5 and/or of the load 9 thus wanes to a standstill. The predetermined desired value W here may advantageously be extremely small. The constant motor torque or the pressure Q constitutes a measure of the weight of the load 9 located on the load-receiving device 7 and may be processed as a corresponding signal.

Using a servomotor as the drive 2 gives the advantage that it itself already contains, or forms, the device 11 for generating the path-dependent signal since it supplies a path-dependent signal S for an angle of rotation a of the drive shaft.

As can likewise be gathered from FIG. 3, the system according to the invention may advantageously have a controller for the vertical Z—Z movement of the load-bearing element 5. The controller illustrated comprises a control member 14, the handling device 10 for the load-receiving device 7 and a device 15 for generating a force-dependent signal P, which corresponds to a manipulation force F acting essentially vertically Z—Z on the handling device 10. The control member 14 may be designed here such that, in dependence on a deviation AP of the force-dependent signal P from a desired value V, it emits a control signal T for the drive 2 for the purpose of initiating a movement of the load-bearing element 5. This movement may then correspond preferably to the direction and preferably also to the magnitude of the manipulation force F.

FIG. 3 also illustrates that the system according to the invention may have a setting member 16 which, in dependence on a signal (e.g. current I, pressure Q) corresponding to the load 9, changes the desired value V for the force signal P, which corresponds to the manipulation force F acting vertically on the handling device. Moreover, the setting member 16 may also be designed such that it changes the transmission behavior of the control member 14, which, in dependence on the deviation ΔP of the force signal P from the desired value V, emits the control signal T for the drive. As has already been mentioned, such guidance regulation is advantageously suitable for compensating for load-induced frictional forces occurring in the system according to the invention, for example on the drum 6 for the load-bearing element 5 or in a gear mechanism. The manipulation force F can be minimized in this way.

The controller for the vertical Z—Z movement of the load-bearing element 5—including the force for load movement—can be used (with and without guidance regulation) irrespective of the presence or type of load-balancing regulation. It is thus possible, for example, for the drive 2 of a system without a regulating circuit for load-balancing purposes to be speed-controlled directly via the manipulation force F. Such a controller is particularly suitable, for example, for palletizing loads 9 with a vertical Z—Z movement of the load-bearing element 5 taking place from top to bottom as the main advancement movement. In this case, the vertical Z—Z movement of the load-bearing element 5 (downward movement) may advantageously be braked in dependence on the magnitude of the path-dependent signal S. It is thus possible, for example, for the load 9 to be set down very smoothly because, in the last stretch of the vertical Z—Z transporting path, the desired value V and/or the transmission behavior of the actuating member 16 may be such that a relatively large manipulation force F—in comparison with the conditions on the rest of the transporting path—corresponds to a relatively small displacement of the load-bearing element 5 and/or of the load-receiving device located thereon. Such a possibility is illustrated by the signal flow path for the path-dependent signal S, which is depicted as a dashed line in FIG. 3.

In order to increase the safety of the operator 8, the system according to the invention may be provided with a number of safety functions. It is thus possible—and this can also be gathered from FIG. 3—to provide a safety controller for a manually operable load-receiving mechanism of the load-receiving device 7, in particular for a clamping or gripping mechanism, such as the clamping grippers illustrated in FIG. 1. Such a safety controller may have a safety control member 17 which is connected to the device 11 for generating the path-dependent signal S and to the device 15 for generating the path-dependent signal P and blocks the manual operation of the load-receiving mechanism and only releases it (signal B) when, in the presence of the force-dependent signal P, there is no path-dependent signal S present. The latter is the case when the load 9 is positioned on a rest. In particular, despite a vertical Z—Z downwardly-directed manipulated force F, the load 9 then no longer moves and, accordingly, a path-dependent signal S is no longer sensed either.

The path-dependent signal S may also be used in order to bring about braking when a maximum displacement speed of the load-bearing element 5 has been exceeded.

For the drive 2 and/or for blocking the movement of the load-bearing element 5, a further safety controller may be integrated in the system according to the invention. This is also shown in FIG. 3. This safety controller may have a sensor 18, in particular a light barrier, for registering the use of the handling device 10 and may also have a switching member 19 which switches off the drive 2 and/or blocks the movement of the load-bearing element 5 and only switches on and/or releases the same (signal U) when the sensor 18 signals the use of the handling device 10 (signal A).

The regulating member 12 of the regulating circuit for load-balancing purposes and/or the control member 14 of the control means for the vertical movement of the load-bearing element 5 and/or the setting member 16 for the desired value V of said controller and/or the switching member 19 of the safety controller for the drive 2 and/or for blocking the load-bearing element 5 and/or the safety control member 17 of the safety controller for the load-receiving device 10 may advantageously, separately or together, be constituent parts of a programmable controller SPS. This is indicated in FIG. 3 by the lines enclosing the abovementioned components. In particular, in addition to the possibility of individual adaptation to a wide range of different handling tasks using the programmable controller SPS, on account of digitized signal processing, it is also possible for the dynamic behavior of the control system to be influenced in a very favorable and flexible manner.

The programmable controller SPS may advantageously be arranged in the vicinity of the drive 2, in particular in the lifting subassembly 3 which accommodates the drive 2, as has already been shown in FIG. 2.

Figure 4:
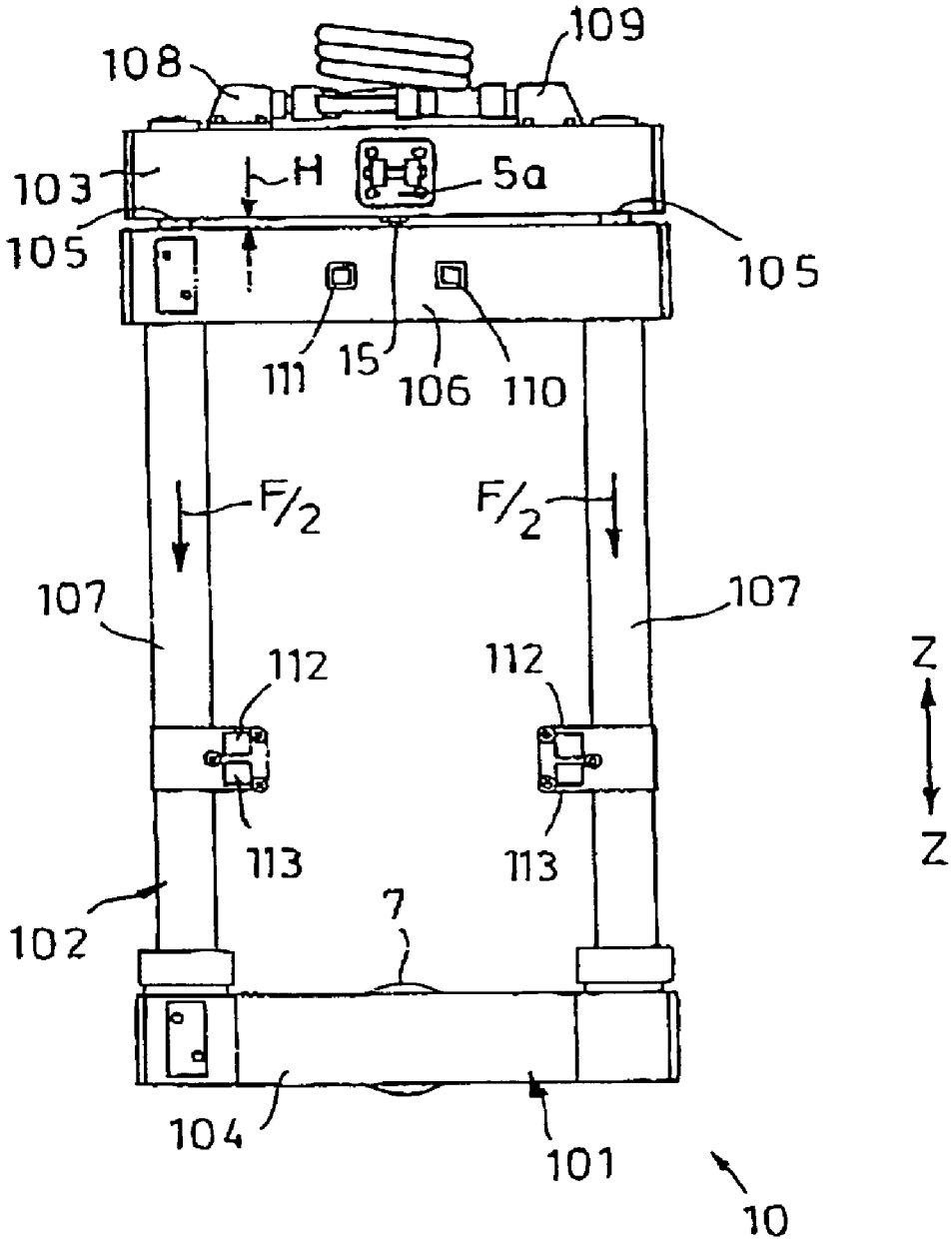
FIG. 4 shows a front view of a first configuration of a handling device of a system according to the invention.

FIG. 4 shows, by way of example, how a handling device, designated 10 in FIG. 1, of a system according to the invention may be designed. The handling device 10 is designed for the operator 8 to operate with both hands, and is of frame-like form. The essential factor for the configuration illustrated is that the handling device 10 comprises at least two main parts 101, 102, of which the first part 101 is connected in a fixed manner, on the one hand, on a top cross-strut 103, to the load-bearing element 5 (fastening location 5*a*) and, on the other hand, on a bottom cross-strut 104, to the load-receiving device 7 (clamping grippers). The two cross-struts 103, 104 of the first part 101 are fastened on one another via laterally arranged tubular connectors 105, with the result that the abovementioned frame-like basic shape is produced.

The second part 102, on which the manipulation force F acts, is arranged such that it can be moved relative to the first part 101, and is of a shorter overall length than the first part 101. It likewise has a cross-strut 106, which is located between the two cross-struts 103, 104, in particular in the vicinity of the top cross-strut 103, of the first part 101. Laterally arranged tubular connectors 107 are likewise fastened on the cross-strut 106 of the second part 102, and these each form handles for the manual operation, enclose the tubular connectors 105 of the first part 101 concentrically and, on the underside, are mounted resiliently on the first part 101. During operation, approximately half the manipulation force F/2 acts on each handle.

Arranged as the device 15 for providing the force dependent signal P, as has been explained with reference to FIG. 4, on the handling device 10 is at least one, in particular inductive, displacement sensor for sensing the change in position of the two parts 101, 102 relative to one another which occurs under the action of the manipulation force F. The displacement sensor signals, in particular, a change DH (see also FIG. 4) in a distance H between the top cross-strut 103 of the first part 7.01, and the cross-strut 106 of the second part 102, of the handling device 10.

FIG. 4 also shows connections 108, 109 to the compressed-air supply of the load-receiving device 7 and to the power supply, these being located on the top cross-strut 103 of the first part 101. Also arranged on the cross-strut 106 of the second part are an on switch 110 and an off switch 111 for the controller of the vertical Z—Z movement of the load-bearing element 5. Further switches 112, 113 for manual operation (operation using both hands) are located on the two tubular connectors 107, designed as handles, of the second part 102. These serve for activating the pivoting and/or release function of the clamping grippers. As has already been mentioned, using the safety controller, by means of a safety control member 17, the manual operation, in particular the release function, of the load-receiving mechanism can be blocked and can only be released when, in the presence of the force-dependent signal P, there is no path dependent signal S present.

Figure 5:
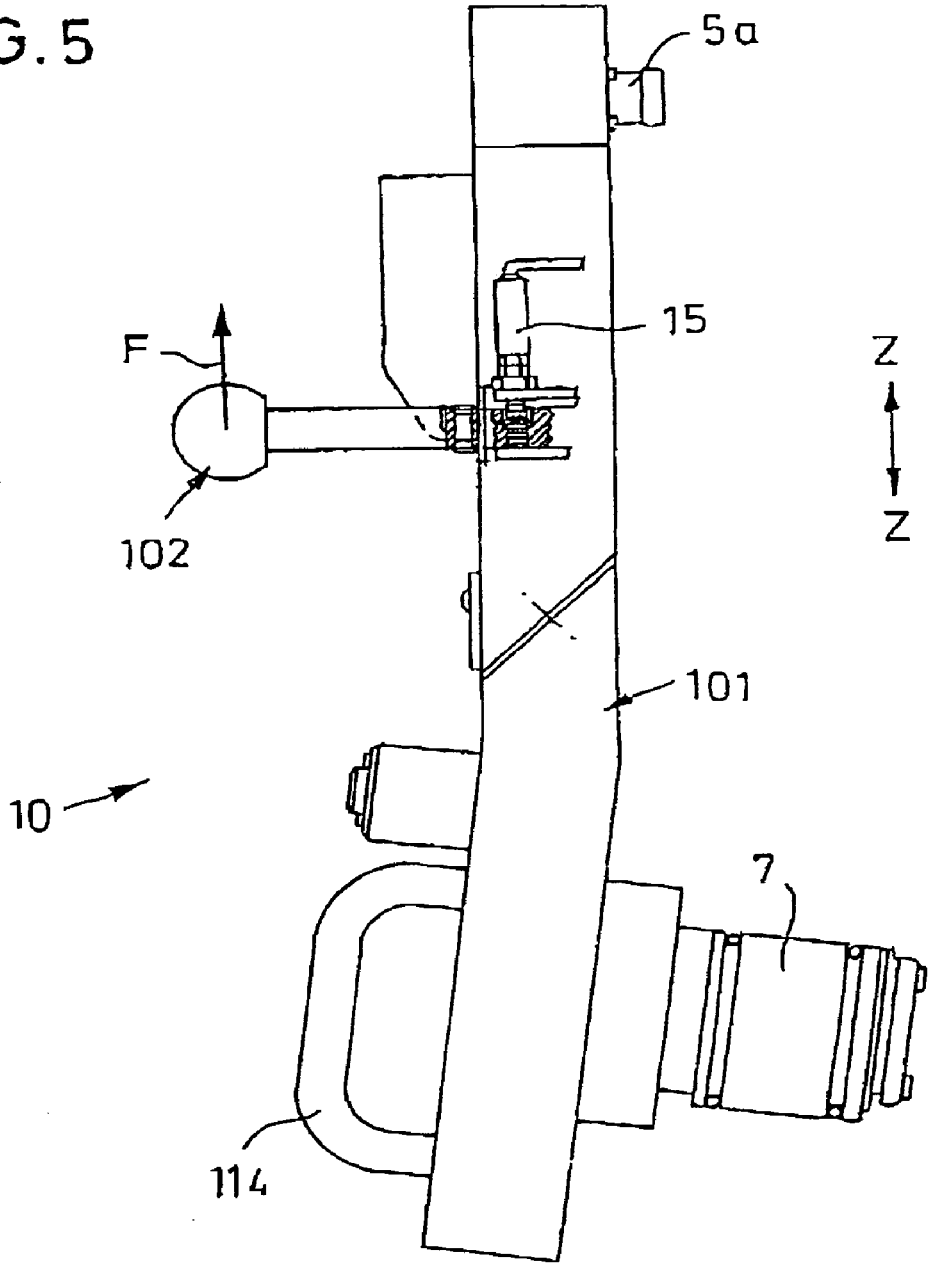
FIG. 5 shows a side view, partly in section, of a second configuration of a handling device of a system according to the invention.

FIG. 5 shows a further configuration of a handling device 10 of a system according to the invention. This handling device 10 is designed for the operator 8 to operate with one hand, and is of elongate form. It is also essential for this configuration that the handling device 10 comprises at least two main parts 101, 102, of which the first part 101 is connected firmly, on the one hand, to the load-bearing element 5 on the top side and, on the other hand, to the load-receiving device 7 on the underside. In this embodiment, the second part 102 is designed as a hand lever which is connected to the device 15 for providing the force-dependent signal P—likewise, in particular, an inductive displacement sensor. The displacement sensor is located in the interior of the first part 101 and supplies a signal P for a distance (not designated specifically in FIG. 5) between the two main parts 101, 102, it being possible for said distance to be changed by the manipulation force F applied to the hand lever. A handle 114 which is installed in a fixed manner on the first part 101 is provided for movement guidance of the handling device 10.

By virtue of this sensor arrangement and selection, in the case of the two embodiments (FIGS. 4, 5) of the handling device 10, the manipulation force F can be sensed in a highly precise manner. The two configurations of the handling device 10 may be used in combination with both an electromotive and a fluidic drive 2.

Figure 6:
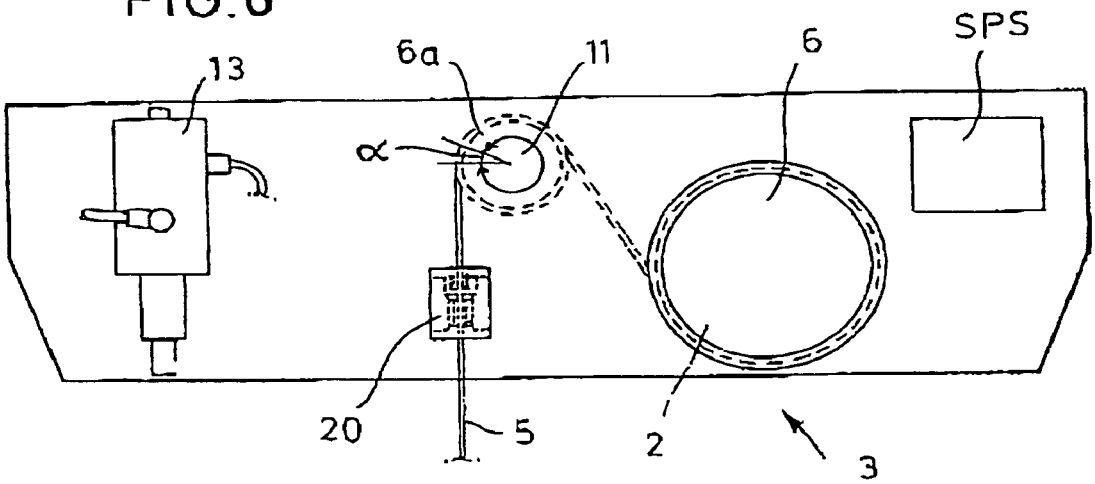
FIG. 6 shows, in a simplified illustration, a section through a lifting subassembly of a system according to the invention with a fluidically acting drive.

A system according to the invention with an already mentioned second drive variant—a fluidically acting drive 2—is illustrated in FIG. 6 in a manner analogous to FIG. 2. The lifting subassembly 3, once again, has a housing 3*a* in which the drum 6 for winding up the cable (load-bearing element 5) and, as the fluidically acting drive 2, in the simplest case a pneumatic cylinder may be located. The drawing, however, indicates a different, pneumatic drive 2 which is known per se. Such a drive 2 may comprise, for example, a laterally closed-off cylinder jacket and a ball screw installed in a fixed manner therebetween. By virtue of the ball screw, it is possible for a translatory movement—produced when a piston located within the cylinder jacket is subjected to compressed air—to be converted into a rotary movement for driving the drum 6. In this configuration, the device 11 for generating the path-dependent signal S is an incremental encoder which may preferably be arranged coaxially with the drum 6 or—as illustrated—on a deflecting roller 6*a* for the load-bearing element 5. The path-dependent signal S thus corresponds to an angle of rotation a of the drum 6. For a system according to the invention with a fluidically acting drive 2, it is possible—as is shown in the illustration—to provide a further safety device. This is a fluidically, in particular pneumatically, acting brake 20 for the flexible load-bearing element 5, in particular for a cable.

Figure 7:
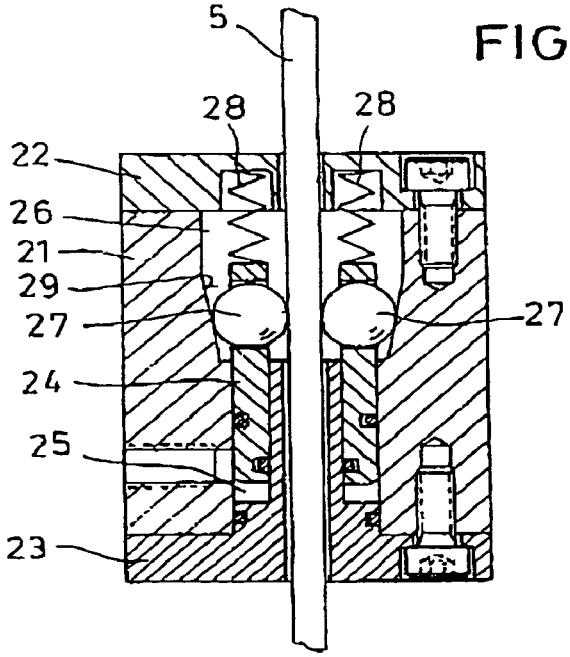
FIG. 7 shows a longitudinal section through a safety device for a system according to the invention with, in particular, a fluidically acting drive.

The brake 20 is illustrated on its own in FIG. 7. It has a cylinder-like housing 21 with a cover 22, which closes off the housing 21 on the top side, and a base plate 23, which closes off the housing 21 on the underside. A piston 24 is guided such that it can be moved longitudinally in the housing 21, said piston subdividing the housing 21 into a sealed pressure chamber 25 for a pressure-generating fluid and into a spring chamber 26. The cover 22, base plate 23 and piston 24 each have a lead-through opening (not designated specifically) for the load-bearing element 5. Arranged in the spring chamber 26, around the load-bearing element 5, are at least two blocking elements 27, which, in the configuration illustrated, are balls. The blocking elements 27 are subjected to the action, on the one hand, of springs 28 and, on the other hand, of the piston 24 under the fluid-pressure action. The spring chamber 26 has a region 29 which tapers in the direction of the piston 24 such that the blocking elements 27, when they are located, in the presence of the fluid-pressure action, in a spring-side part of said region 29, release the load-bearing element 5 and, when they are moved, in the absence of the fluid-pressure action, into a piston-side part of the region 29 under the action of the springs 28, arrest the load-bearing element 5 in the housing 21. By virtue of this safety device, it is possible to prevent the load 9 from crashing down if the operating pressure of the fluid fails.

A great disadvantage of fluidic drives 2 resides in the risks which are based on a load 9 being suddenly released from the load-receiving device 7 in an undesired manner. As a result of the abrupt absence of the load 9, this results in an explosive reaction in the drive 2, in which case the load-bearing element 5 is torn upward. The above described brake 20 may also advantageously be used in order to prevent such situations from a safety point of view. For this purpose, the brake 20 can be installed, in the lifting subassembly 3, in an installation position which is rotated through 180° in relation to the installation position shown in FIGS. 6 and 7. The path-dependent signal S, which corresponds to an essentially vertical Z—Z movement—in this case upward movement—of the load-bearing element 5, may then additionally be used as an input signal for controlling the brake 20, to be precise for opening a pressure relief valve for the pressure chamber 25. It is thus possible to prevent a sudden upward movement of the load-bearing element 5, there being generated, in the brake 20, a force which opposes the force of the fluidic drive 2 and prevents the drive 2 from being destroyed and hazardous situations from arising. A brake 20 in the installation position shown in FIGS. 6 and 7 may advantageously be combined with a brake 20 in the position rotated through 180°.

In particular in the presence of a fluidically acting drive device for the load-bearing element, it is advantageously possible to provide, in particular, an exchangeable storage battery for the power supply of the regulating circuit for load-balancing purposes, of the controller for the vertical Z—Z movement of the load-bearing element 5, of the safety controllers) and/or the programmable controller (SPS). There is then no need for a mains power supply. Such a storage battery may be arranged, for example, on or in the handling device 10, with the result that it can easily be removed from the system and reconnected once it has been charged up.

In contrast to the above described configurations, it is also possible for the load-bearing element 5 to be designed rigidly, for example as a rack or the like. If such a rack is to be used, a corresponding pinion, for engagement in the teeth of the rack, may be provided on the drive 2 for movement-initiation purposes. The device 11 for generating the path-dependent signal S may then also be designed such that it is possible to sense an essentially vertical Z—Z movement of such a rack. For this purpose, in order to provide the path-dependent signal S, it is also possible to use sensors by means of which a linear displacement of the load-bearing element 5 is sensed directly.

Figure 8:
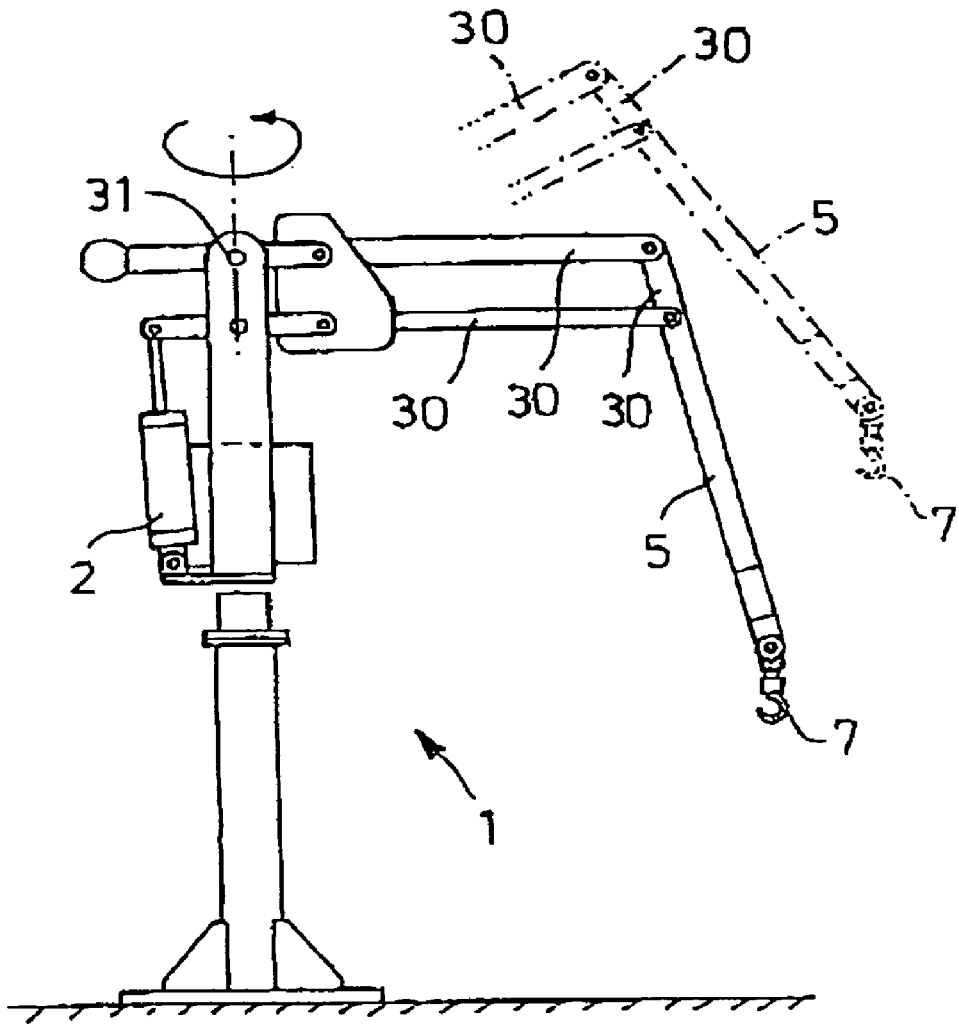
FIG. 8 shows a further configuration of a system according to the invention, with a flexurally rigid load-bearing element.

A further possibility for flexurally rigid design of the load-bearing element has already been indicated in the introduction. Such an arrangement, which is similar to the manipulator known from DE 4342715 A1, may also—see FIG. 8—be designed such that, the load-bearing element 5 comprises a load-bearing parallelogram in which sub-arms 30 are connected to one another at joints 31 with a horizontal pivot axis, it being possible to change the angle position and the lengths of the sub-arms 30 of the load-bearing parallelogram located within a vertical plane (illustration in dashed lines). With such an arrangement, the path-dependent signal S may likewise correspond to an angle of rotation a, to be precise to an angle by which two sub-arms 30 of the load-bearing parallelogram which are connected to one another via a joint 31 in each case, move in relation to one another. The device 11 for generating the path-dependent signal S may then advantageously, once again, be an incremental encoder which is arranged coaxially with the pivot axis of the joints. The system which is shown in figure B is, once again, a system with a fluidic drive 2 (pneumatic unit or hydraulic cylinder). For such a system, the device 11 for generating the path-dependent signal S may also be a sensor which is arranged on the piston rod and is intended for sensing the linear displacement. In this case, the load-receiving device 10 is formed simply by a load hook.

It has already been possible to gather from the above configurations that the present invention, rather than being limited to the exemplary embodiments illustrated, also covers means and measures which act in the same way in the context of the invention, such as configurations of the drive 2 which have not been described here. For example, also possible as the drive 2 is a combination of a linearly acting fluidic piston/cylinder arrangement with a roller arrangement, constructed in the manner of a block and tackle, for movement-deflection purposes, it being possible for an incremental encoder to be arranged, coaxially with the rollers, as the device 11 for generating the path dependent signal S.

As the sensors for sensing the manipulation force F or for providing the path-dependent signal S, it is also possible to use sensors other than those which have been described here.

The person skilled in the art also has a variety of possible ways of configuring the invention further. For example, for its movements in the horizontal direction X—X and/or Y—Y, it is also possible for the load-lifting apparatus 1 to be assigned at least one drive device which can be activated in dependence on a forced deflection of the load-bearing element 5—said deflection being based on the vertical alignment Z—Z which is established automatically as a result of gravitational force in the rest position—and which has a specific control system for this purpose. In this respect, reference is made in full to the German Utility Model DE 297 19 865 U1 mentioned in the introduction.

Furthermore, rather than being limited to the combination of features defined in the claims, the invention may also be defined by any other desired combination of specific features of all the individual features disclosed in their entirety. This means that basically virtually any individual feature of a claim can be omitted and/or replaced by at least one individual feature disclosed at some other point of the application.

What is claimed is:

1. A system for controlling a load lifting apparatus (1), comprising a controllable drive (2);

a load-bearing element (5) connected to the drive (2) and aligned at least in a vertical path (Z—Z) as a result of gravitational force in a rest position of the load-bearing element;

a load-receiving device (7) connected to the load-bearing element (5); and a regulating circuit operatively associated with the controllable drive (2) for load-balancing purposes, the regulating circuit comprising:

a device (11) responsive to movement of the load-receiving device on the vertical path (Z—Z) for generating a signal (S) for balancing the load (9) in the vertical path without presetting the weight of the load;

the regulating circuit operating, after the load (9) is received by means of the load-receiving device (7), to automatically increase the torque of the drive (2) until a substantially vertical (Z—Z) movement of the load bearing element (5) out of the rest position begins, thereby causing the device (11) to generate the signal (S), which contains information dependent on and corresponding to an incremental course of movement covered during the beginning of the substantially vertical (Z—Z) movement of the load bearing element (5), and which provides an input signal for controlling the drive (2) so as to balance the load in the vertical path (Z—Z); and the regulating circuit operating to constant-switch the drive (2) in response to a zero deviation (ΔS) of said signal (S) from a predetermined value (W), so as to maintain the load-receiving device (7) and the load balanced in the substantially vertical path.

2. A system for controlling a load lifting apparatus (1), comprising a controllable drive (2);

a load-bearing element (5) connected to the drive (2) and aligned at least in a vertical path Z—Z) as a result of gravitational force in a rest position of the load-bearing element;

a load-receiving device (7) connected to the load-bearing element (5); and a regulating circuit operatively associated with the controllable drive (2) for load-balancing purposes;

the regulating circuit comprising a device (11) for generating a signal (S)

said device (11) being an incremental encoder which is arranged co-axially with a drum (6) or with a drive shaft of the drive (2) and said signal (S) corresponding to an angle of rotation of the drum (6) or the drive shaft, whereby to balance the load (9) in the vertical path (Z—Z) without the weight of the load being preset, after the load (9) is received by means of the load-receiving device (7) the regulating circuit operates to automatically increase the torque of the drive (2) until a substantially vertical (Z—Z) movement of the load bearing element (5) out of the rest position begins, causing the device (11) to generate the signal (S)

which contains information dependent on and corresponding to an incremental course of movement covered during the beginning of the substantially vertical (Z—Z) movement of the load bearing element (5), and which serves as an input signal for controlling the drive (2) to balance the load in the vertical path (Z—Z); and the regulating circuit operating to constant-switch the drive (2) in response to a zero deviation (ΔS) of said signal (S) from a predetermined value (W), so as to maintain the load-receiving device (7) and the load balanced in the substantially vertical path.

3. A system for controlling a load lifting apparatus (1), comprising a controllable drive (2);

a load-bearing element (5) connected to the drive (2) and aligned in a vertical path (Z—Z) as a result of gravitational force at least in a rest position;

a load-receiving device (7) connected to the load-bearing element (5); and a regulating circuit operatively associated with the controllable drive (2) for load-balancing purposes;

the regulating circuit comprising:

a device (11) for generating a signal (S)

which serves as an input signal for controlling the drive (2) and which contains information dependent on and relating to an incremental movement during an initial course of a substantially vertical (Z—Z) movement of the load bearing element (5), and which serves as an input signal for controlling the drive (2) to balance the load in the vertical path (Z—Z), so that, in response to a zero deviation (ΔS) of said signal (S) from a predetermined value (W), the drive (2) is constant-switched to balance the load with no vertical movement whereby the vertical (Z—Z) movement of the load bearing element (5) out of the rest position decreases to standstill; and a controller for the substantially vertical (Z—Z) movement of the load bearing element (5), the controller comprising:

a handling device (10) for the load-receiving device;

a device (15) for generating a force-dependent signal (P) which corresponds to a manipulation force (F) acting substantially vertically (Z—Z) on the handling device (10);

a control member (14) which is operative in response to a deviation (ΔP) of the force-dependent signal (P) from a desired value (W) to emit a control signal (T) for the drive (2) for initiating and controlling the speed of the vertical (Z—Z) movement of the load bearing element (5), said movement corresponding to the direction and the magnitude of the manipulation force (F); and a setting member (16) which is connected to the drive (2) or to an the actuating member (13) thereof and, operative in response to a signal (I, Q) corresponding to the load (9) or in response to the signal (S), changes the desired value (W), which determines the deviation (ΔP) of the force-dependent signal (P), or changes the transmission behavior of the setting member (16) so that the drive (2) brakes the vertical (Z—Z) movement of the load bearing element (5) in response to the signal (S).

* * * * *

UNITED STATES PATENT AND TRADEMARK OFFICE

CERTIFICATE OF CORRECTION

PATENT NO. : 6,974,044 B1
DATED : December 13, 2005
INVENTOR(S) : Munnekehoff

It is certified that error appears in the above-identified patent and that said Letters Patent is hereby corrected as shown below:

Title page,
Item [22], PCT Filed: should read -- February 10, 2000 --.

Signed and Sealed this

Twenty-third Day of May, 2006

JON W. DUDAS
*Director of the United States Patent and Trademark Office*